US011603775B2

(12) United States Patent
Reverseau et al.

(10) Patent No.: US 11,603,775 B2
(45) Date of Patent: Mar. 14, 2023

(54) REMOVABLE PIN ON A TURBOMACHINE NOZZLE

(71) Applicant: SAFRAN AIRCRAFT ENGINES, Paris (FR)

(72) Inventors: Paul Jean-Jacques Michel Reverseau, Moissy-Cramayel (FR); Didier Pierre Fabre, Moissy-Cramayel (FR); Sabrina Benkaci, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 45 days.

(21) Appl. No.: 17/604,519

(22) PCT Filed: Apr. 27, 2020

(86) PCT No.: PCT/EP2020/061624
§ 371 (c)(1),
(2) Date: Oct. 18, 2021

(87) PCT Pub. No.: WO2020/233947
PCT Pub. Date: Nov. 26, 2020

(65) Prior Publication Data

US 2022/0195891 A1 Jun. 23, 2022

(30) Foreign Application Priority Data

May 21, 2019 (FR) ..... 1905298

(51) Int. Cl.
*F01D 25/24* (2006.01)
*F01D 9/04* (2006.01)

(52) U.S. Cl.
CPC ..... *F01D 25/24* (2013.01); *F01D 9/04* (2013.01); *F05D 2230/64* (2013.01)

(58) Field of Classification Search
CPC ..... F01D 25/24; F01D 25/246; F01D 9/042; F01D 5/082; F05D 2230/64; F05D 2250/12; F05D 2250/131; F05D 2260/30
See application file for complete search history.

(56) References Cited

U.S. PATENT DOCUMENTS 5,201,846 A * 4/1993 Sweeney ..... F01D 9/04 415/177
5,775,874 A * 7/1998 Boite ..... F01D 25/246 415/209.1

(Continued)

FOREIGN PATENT DOCUMENTS

| | | |
|---|---|---|
| FR | 2960591 A1 | 12/2011 |
| FR | 3066226 A1 | 11/2018 |
| GB | 2309053 A | 7/1997 |

OTHER PUBLICATIONS

International Search Report for PCT/EP2020/061624 dated Jun. 3, 2020.
Written Opinion for PCT/EP2020/061624 dated Jun. 3, 2020.

*Primary Examiner* — Igor Kershteyn
(74) *Attorney, Agent, or Firm* — Sandberg Phoenix & von Gontard, PC

(57) ABSTRACT

A turbomachine assembly, comprising a distributor with a tubular platform, an inner radial flange extending radially inwardly from the platform, and a plurality of vanes extending radially outwardly from the platform; a casing comprising an outer radial flange; an abutment axially holding the outer radial flange in contact with the inner radial flange; a support ring attached to the casing and radially supporting the abutment; wherein the abutment is formed of a head and a body releasably connected to the head.

11 Claims, 4 Drawing Sheets

(56) References Cited

U.S. PATENT DOCUMENTS

| | | | | |
|---|---|---|---|---|
| 2012/0082568 | A1* | 4/2012 | Tibbott | F01D 5/088<br>416/97 R |
| 2013/0078086 | A1* | 3/2013 | Breugnot | F01D 25/246<br>415/182.1 |
| 2015/0322796 | A1* | 11/2015 | Roussely-Rousseau | F01D 5/22<br>415/180 |

* cited by examiner

REMOVABLE PIN ON A TURBOMACHINE NOZZLE

CROSS-REFERENCE TO RELATED APPLICATIONS

The present invention is the US national stage under 35 U.S.C. § 371 of International Application No. PCT/EP2020/061624 which was filed on Apr. 27, 2020, and which claims the priority of application FR 1905298 filed on May 21, 2019, the content of which (text, drawings and claims) are incorporated here by reference in its entirety.

FIELD

The invention relates to a turbomachine assembly. More specifically, the invention relates to the architecture of a turbine and in particular to the mounting support for a distributor in a high-pressure turbine.

BACKGROUND

The published patent document FR 3 066 226 A1 discloses in FIG. 1 a high-pressure turbine distributor, mounted on an annular casing. The distributor comprises a platform supporting an annular row of fixed vanes. An annular row of pins (noted 22) allows a circumferential and radial positioning of a platform flange to a casing flange. An abutment (marked 21) completes the connection between the distributor and the casing, the abutment holding the flanges axially against one another. The abutment is radially supported on a support ring (noted 3). However, with the structure described in the above-mentioned document, removing the distributor requires disassembling the abutment, and disassembling the abutment can only be done by removing the support ring, fixed to the casing.

Thus, several disassembly and reassembly steps are necessary to inspect the distributor. The disadvantages are obvious in terms of the downtime of a turbomachine undergoing repair and in terms of the risks inherent in handling these parts (damages to parts, risk of injury to operators, inspection and reassembly protocol, etc.).

SUMMARY

The purpose of the invention is to propose a design for the coupling of the distributor and the high-pressure turbine casing which allows faster maintenance operations, and in particular to avoid disassembling the support ring and the casing.

The invention relates to a turbomachine assembly comprising: a turbine distributor comprising an annular platform, an inner radial flange extending radially inwardly from the platform, and one or more blades extending radially outwardly from the platform; a casing comprising an outer radial flange; and an abutment providing axial retention of the outer radial flange in contact with the inner radial flange; characterized in that the abutment is constituted by a head and a body removably connected to the head.

According to an exemplary advantageous embodiment of the invention, the assembly can comprise one or more of the following technical features, in any possible combination:

- the head, respectively the body, has an internal thread and the body, respectively the head, has a thread suitable for cooperating with the internal thread. Thus, the body is separated from the head by unscrewing the body and/or the head;

- the body is assembled to the head by means of a bayonet mechanism. This type of non-permanent assembly allows for quick disassembly without the need for special tools. According to an alternative embodiment, other types of snap-fit or snap-in devices are also possible;
- the body and the head are fitted tightly together. Tightening with a mallet can be sufficient because the abutment is not subjected to high forces which could lead to the separation of its two parts. The body can have a portion facilitating its grasping, such as a groove or a non-axisymmetric portion with a polygonal or grooved section, allowing the two parts of the abutment to be disengaged using a tool;
- the head is radially spaced from the flanges. Thus, only the body rests against the radially inner flange;
- the head is T-shaped and comprises an inner portion with a polygonal cross-section and an outer portion that is axisymmetric. Such a shape allows disassembly or assembly of the body on the head in a blind manner, i.e., without having access to the head. For this purpose, a surface of the casing or support ring can, for example, serve as a rotational abutment when one side of the polygon of the head comes to rest on it. The polygonal cross-section can have rounded corners. These prevent damage to the support ring or the casing when the body is dismantled;
- the head passes through the casing. Alternatively, the head is inserted into the casing without passing through it and is held there, for example, by welding or clamping;
- the abutment extends in the radial direction and a plurality of pins extend axially, each of the pins passing through the casing flange and the distributor flange.

The invention also relates to a turbomachine comprising a combustion chamber, the turbomachine being characterized in that it comprises a high-pressure turbine downstream of the combustion chamber, the turbine being equipped with an assembly according to one of the above-mentioned embodiments.

Finally, the invention relates to a method of servicing a turbomachine, which is remarkable in that the turbomachine is according to the embodiment of the preceding paragraph and in that the method comprises, in this order: a step of removing the body of the abutment; and a step of removing the distributor, during which the head of the abutment remains engaged in the casing and the support ring remains fixed to the casing, the method furthermore in various instances comprising a step of reassembling the distributor and then a step of fastening the body of the abutment to the head of the abutment.

The measures of the invention are interesting in that only a part of the abutment has to be disassembled from the casing to allow the disassembly of the distributor. The assembly of the casing and the support ring is thus preserved. Furthermore, as the abutment is not subjected to significant forces during operation, the two parts of the abutment can be assembled by simple means such as quick-fixing.

DRAWINGS

FIG. 1 describes an exemplary turbomachine according to various embodiments of the invention.

DETAILED DESCRIPTION

In the following description, the terms "internal" and "external" refer to positioning relative to the axis of rotation of an axial turbomachine which is also the axis of rotation of the turbine. The axial direction is the direction along the axis of rotation of the turbomachine. The radial direction is perpendicular to the axis of rotation. Upstream and downstream are in reference to the main flow direction of the flow in the turbomachine. The term "integral" is understood to mean rotationally integral, and in particular rigidly linked. The term "monobloc" is equivalent to "made from the same material" and designates different elements made from the same block of material, as opposed to "attached", which means that one element is attached to another element after these elements have been manufactured. The figures represent the elements in a schematic manner, in particular without all the assembly or sealing elements. some of the dimensions of the elements drawn, and in particular their radial thicknesses, are exaggerated in order to facilitate understanding of the figures.

The term "distributor" means a set of circumferentially adjacent angular sectors forming an annular row of stationary vanes, each of the angular sectors can have at least one, for example two or three stationary vanes.

Figure 1:
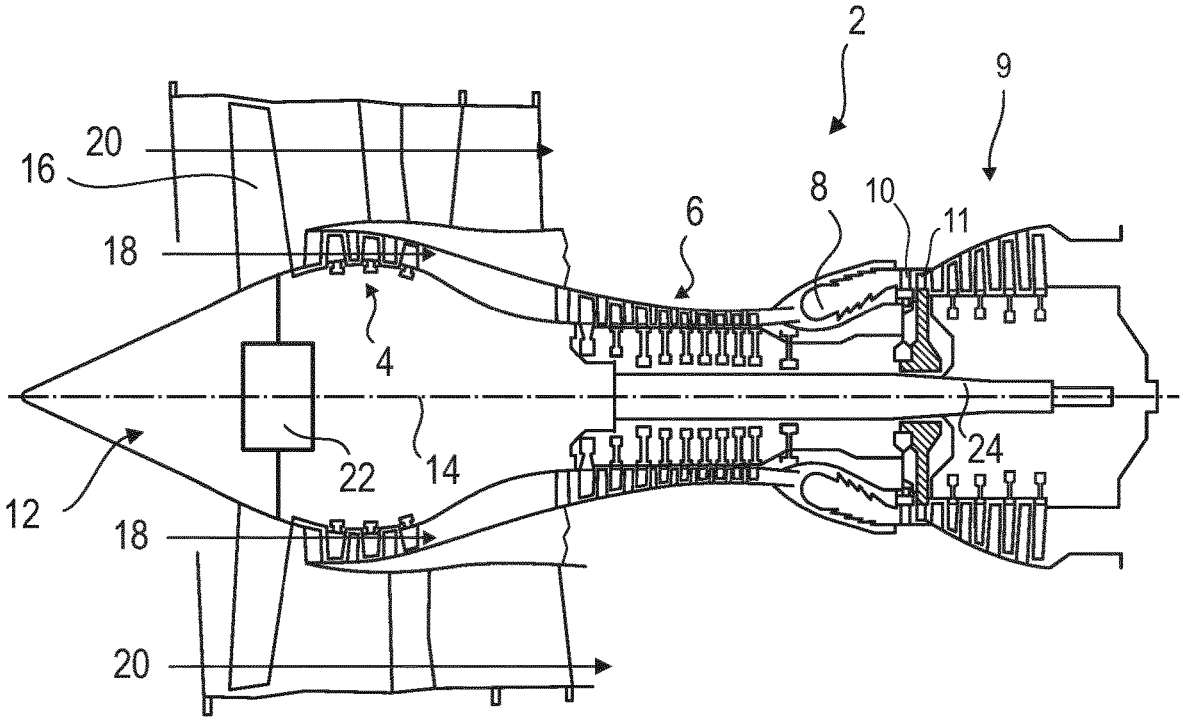

FIG. 1 shows a simplified representation of an axial turbomachine 2. The turbomachine 2 comprises a low-pressure compressor 4 and a high-pressure compressor 6, a combustion chamber 8 and one or more turbines 9. In operation, the mechanical power of the turbine 9 transmitted to the rotor 12 sets in motion the two compressors 4 and 6. These compressors have several rows of rotor blades associated with rows of stator blades. The rotation of the rotor around its axis of rotation 14 thus makes it possible to generate a flow of air and to progressively compress the latter up to the inlet of the combustion chambers 8.

A fan 16 is coupled to the rotor 12 and generates an air flow which divides into a primary flow 18 and a secondary flow 20 passing through an annular duct (partially shown) along the machine and then rejoining the primary flow at the turbine outlet.

Reduction means, such as an epicyclic gearbox 22, can reduce the rotational speed of the fan and/or low-pressure compressor relative to the associated turbine. The secondary flow can be accelerated so as to generate a thrust reaction required for making an aircraft fly.

The turbine(s) 9 comprise alternating rotating blades and fixed blades. The term "distributor" will be used in this application to refer to an assembly of fixed blades and their supporting platform. The platform can be a full ring or a circumferential segment (partial ring). The first distributor downstream of the combustion chambers 8 is indicated by the number 10 in FIG. 1. It is followed by an impeller 11.

Figure 2:
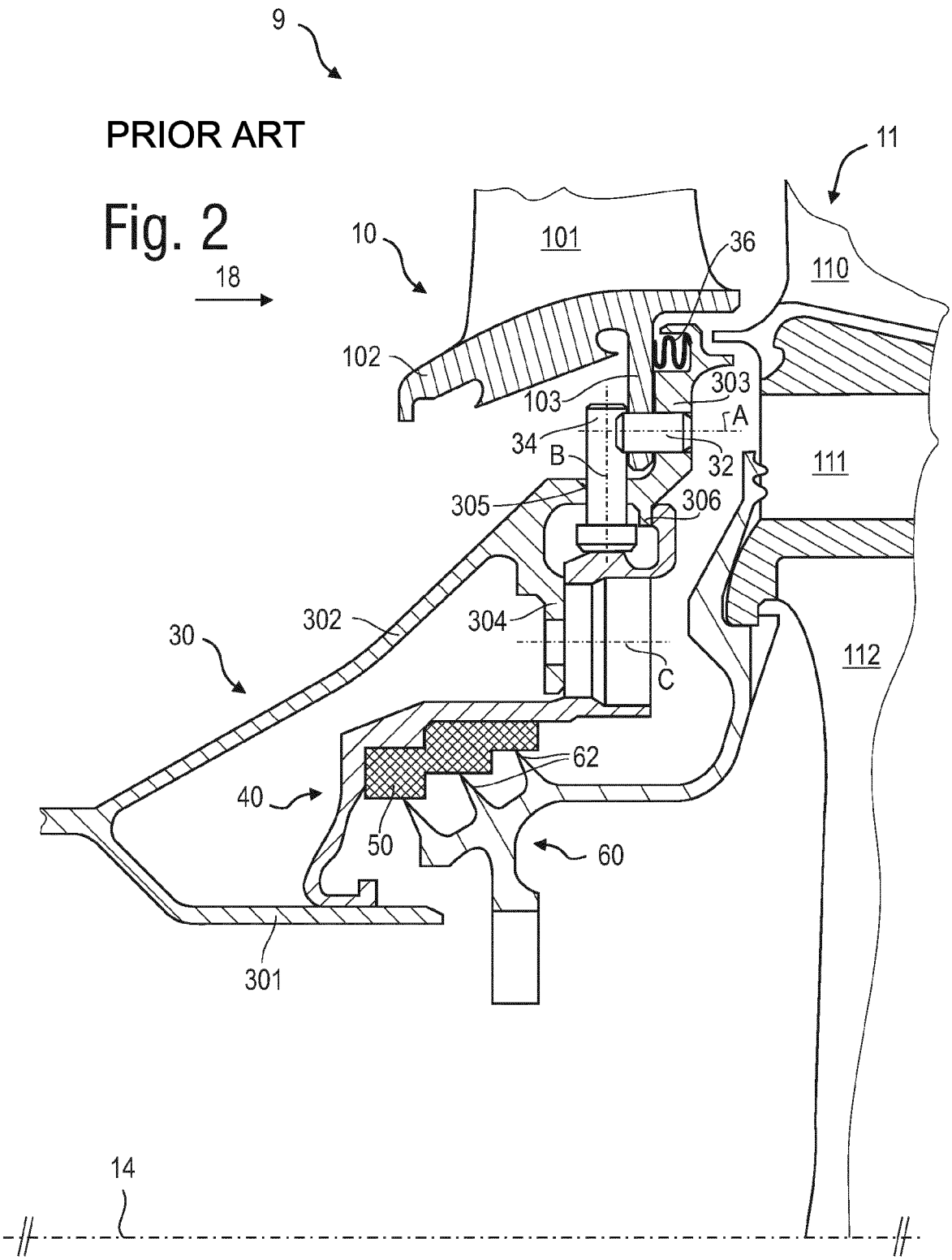
PRIOR ART Fig. 2
FIG. 2 shows a partial cross-section of a known turbine.

FIG. 2 is a cross-sectional view showing a turbine stage 9 according to a known construction. The turbine stage 9 consists of a distributor 10 and an impeller 11.

The impeller 11 comprises an annular row of moving blades 110 each mounted in a cell 111 of a disc 112.

The distributor 10 comprises an annular row of fixed vanes 101 connected by their inner ends (root) to an annular lower platform 102. The platform 102 has a flange 103 extending radially inwardly. This flange 103 allows the blades 101 to be made integral with the fixed annular casing 30.

The blades 101, 110 extend radially into the hot, high pressure air stream 18.

The casing 30 includes an inner spindle 301, an outer spindle 302, an outer radial flange 303 and an inner radial flange 304. The spindles 301, 302 are coaxial along the axis 14.

The radially outer flange 303 is in axial contact with the inner flange 103, the flange 303 being downstream of the flange 103. The flanges 103, 303 are positioned and held radially and circumferentially to each other by means of pins 32, angularly distributed about the axis 14. The pins 32 extend axially through the flanges 103, 303.

The pin 32 that is visible in the cross-section of FIG. 2 extends along an axis noted A which is parallel to the axis 14.

The flanges 103, 303 are held axially against each other by an abutment 34. This abutment extends radially along an axis noted B. The axes A and B are shown in FIG. 2 to facilitate understanding of the invention, but these axes are not in the same plane, the abutment 34 being circumferentially offset from the pins 32. The abutment 34 extends through a hole 305 provided in the casing 30.

A seal 36 housed in the flange 303 prevents air leakage from the air passage 18 into the interior.

The abutment 34 is radially supported by a support ring 40. The support ring 40 is connected to the casing 30 at its inner flange 304 by a screw assembly (not shown) extending along the C-axis. The support ring 40 is also radially supported by the internal spindle 301 of the casing 30. Finally, the support ring 40 can be supported on a lip 306 of the casing 30. The support ring 40 is provided with an abradable layer 50 to ensure a seal by cooperating with lips 62 of a rotating flange 60, integral with the impeller 11.

FIG. 2 illustrates the assembly in its assembled configuration. In order to remove the distributor 10, it is necessary to first remove the abutment 34. However, the abutment 34 can only be removed from the casing 30 after disassembly of the support ring 40. The objective of the invention is to reduce the number of disassembly steps required to remove the distributor.

Figure 3:
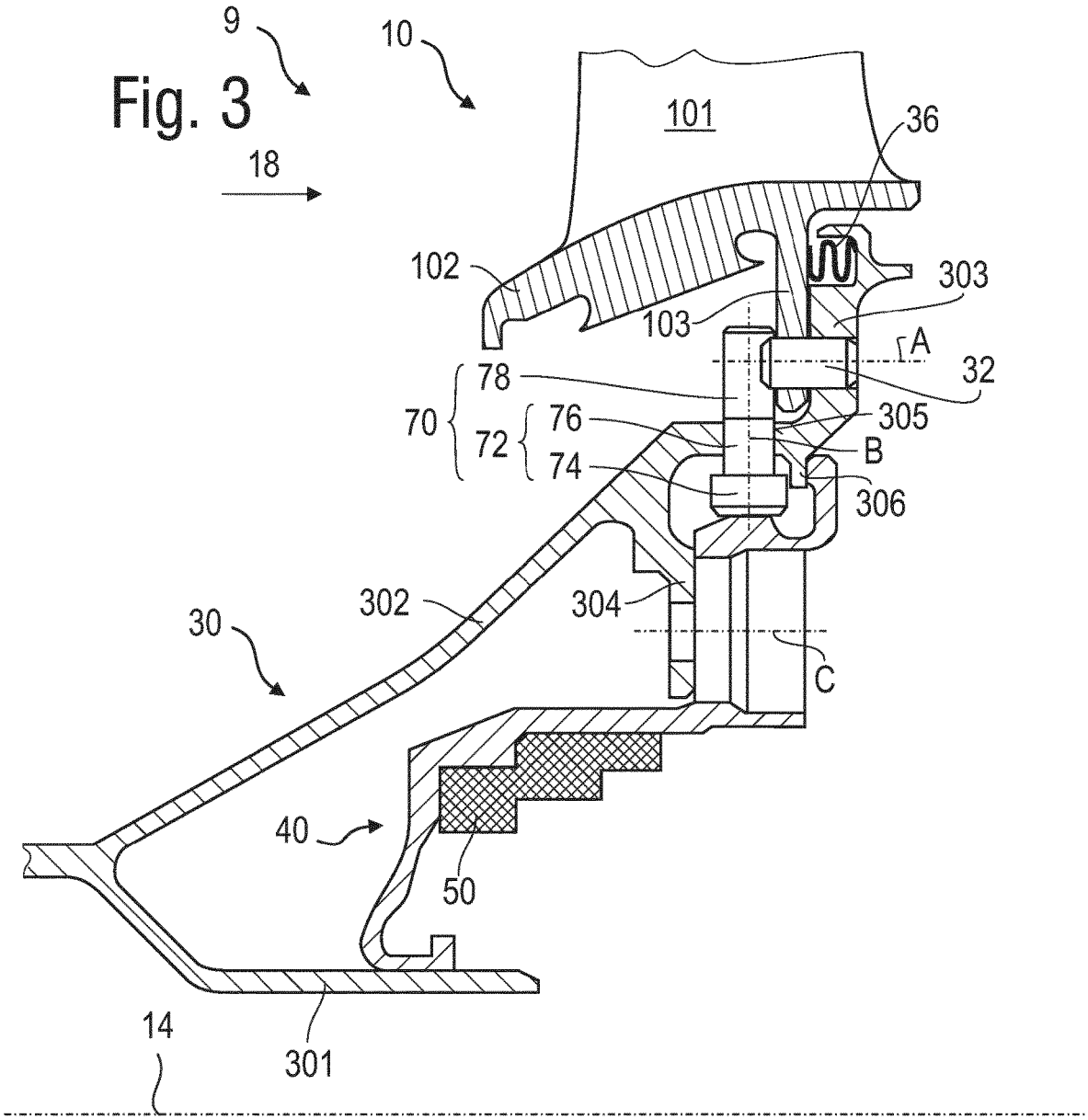
FIG. 3 shows an exemplary partial cross-sectional view of a turbine according to various embodiments of the invention.

Thus, FIG. 3 represents a partial cross-sectional view of an assembly according to the invention. Parts similar to the known assembly shown in FIG. 2 retain their reference numbers. The invention differs essentially from the known assembly in the design of the abutment.

In FIG. 3, the abutment is referenced 70. It comprises a head 72 and a body 78. The head 72 includes an inner portion 74 and an outer portion 76 that extends through the opening 305 of the casing 30. The inner portion 74 has a dimension (diameter if it is a cylinder or diagonal if it is a polygon) that is greater than the diameter of the orifice 305 so that the inner portion 74 does not penetrate the orifice 305. The head 72 is supported via its inner portion 74 by the support ring 40, attached to the casing 30.

According to the invention, the head 72 is detachably connected to the body 78.

In other words, the head 72 and the body 78 are reversibly separable from each other.

In an alternative embodiment which is not shown, the head does not pass through the casing. It is received in a housing provided for this purpose. The head is welded to the casing or mounted tightly in its casing, so as to remain integral with the casing when the body is dismantled.

The body 78 is adapted to contact the flange 103 to prevent axial disengagement of the flanges 103, 303. Thus, the body radially overlaps the inner flange 103. By radial overlap, it is meant that there exist geometric points of the body 78 that have identical radial coordinates as some geometric points of the flange 103. The head 72 is at a radial distance from the internal flange 103 in order to allow, once the body 78 is removed, the axial sliding of the distributor 10 upstream (towards the left in FIG. 3).

Figure 4:
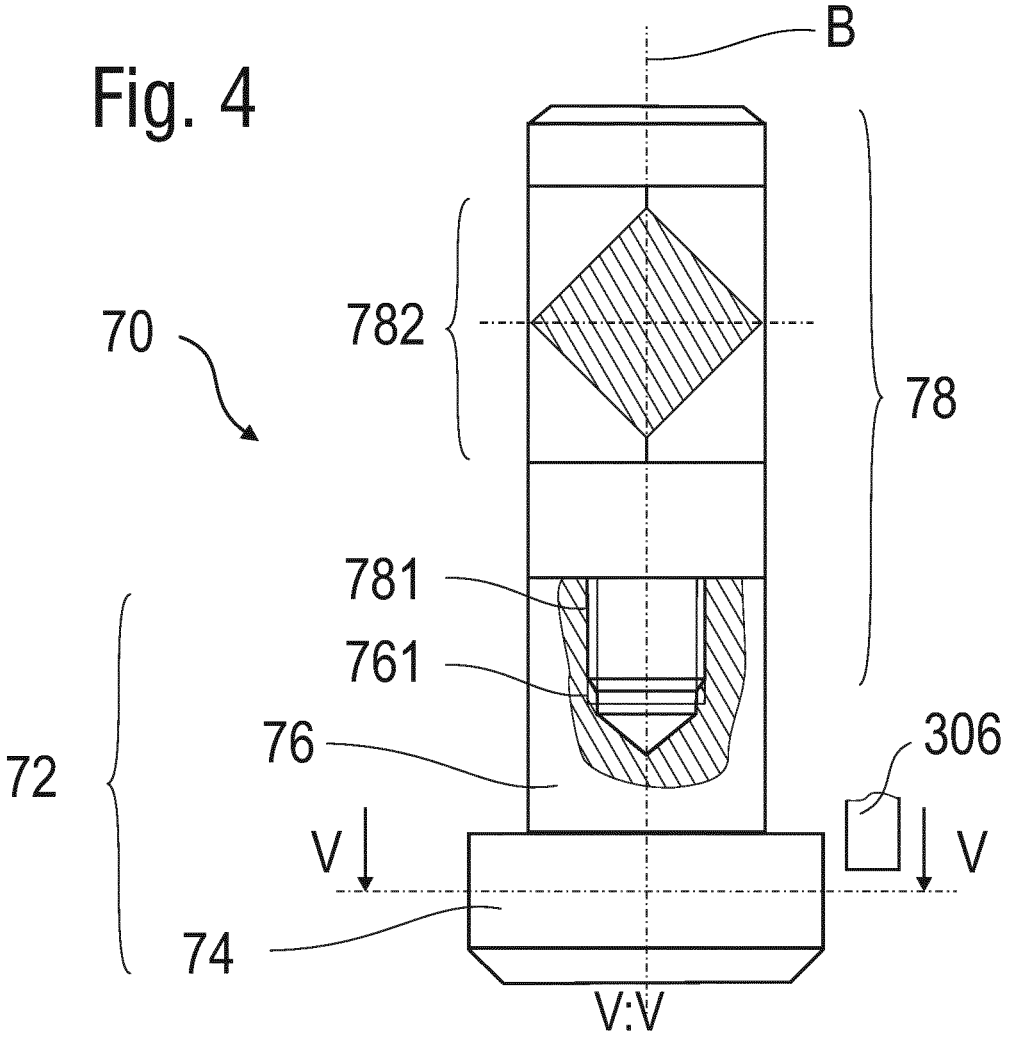
FIG. 4 shows an exemplary embodiment of the abutment according to various embodiments of the invention.

FIG. 4 illustrates an example of an embodiment of the abutment 70. In this example, the head 72 includes a threaded bore 761 which a threaded portion 781 of the body 78 engages. The body 78 can have a portion helping grasping it for unscrewing purposes, such as a portion with a square section 782.

Except for section 782, the body 78 and the outer portion 76 of the head 72 have generally axisymmetric shapes about the B axis.

FIG. 4 also partially shows the lip 306 of the casing which is proximate to the inner portion 74.

Figure 5:
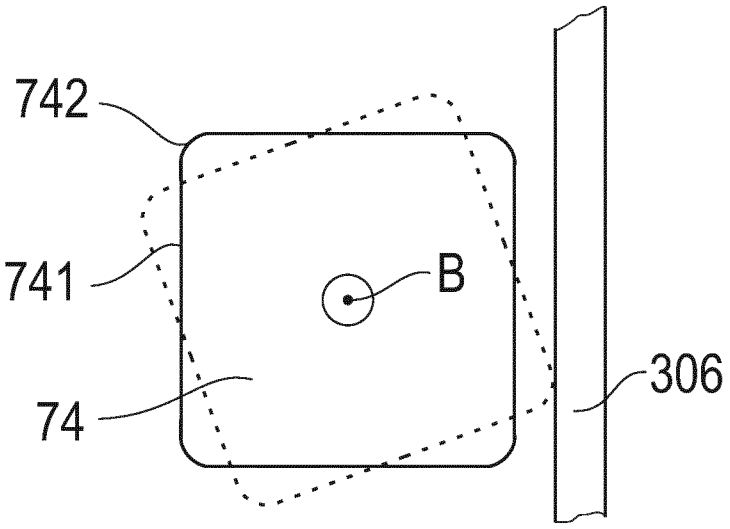
FIG. 5 shows a detail of the abutment, seen in the direction indicated as V:V in FIG. 4, in accordance with various embodiments of the invention.

FIG. 5 illustrates the inner portion 74 as viewed in the direction indicated as V:V in FIG. 4, showing the substantially polygonal cross-section 741 of the inner portion 74, which in this example is a square. The square 741 can have rounded corners 742. The dotted line shows a position of the inner portion 74 in contact with the lip 306. Indeed, when unscrewing the body 78 blindly—that is, without holding or having access to the head 72 of the abutment 70—if the inner portion 74 has a polygonal cross-section, the inner portion 74 can pivot and come to rest on a surface so as to be stopped in rotation and allowing unscrewing of the body 78 without the inner portion 74 turning freely. In the illustrated example, the abutment surface is a surface of the lip 306.

It will be understood by the skilled person that, alternatively to the lip 306, rotation of the inner portion 74 can be stopped by the inner flange 304 of the casing or by a surface of the support ring 40.

Alternatively or additionally, the contact surface between the support ring 40 and the abutment 70 can also stop the head 72 in rotation: for example, the support ring 40 can be provided with slots and the inner portion 74 can be provided with grooves (radial to the axis B) which can engage the slots.

The invention claimed is:

1. A turbomachine assembly, said assembly comprising:

a turbine distributor comprising an annular platform, an inner radial flange extending radially inwardly from the platform, and one or more vanes extending radially outwardly from the platform;

a casing comprising a radially outer flange; and an abutment axially holding the radially outer flange in contact with the inner radial flange;

wherein the abutment is constituted by a head and a body, the body being removably connected to the head.

2. The assembly according to claim 1, wherein the head has an internal thread and the body has a thread able to cooperate with the internal thread.

3. The assembly according to claim 1, wherein the body has an internal thread and the head has a thread able to cooperate with the internal thread.

4. The assembly according to claim 1, wherein the body is connected to the head by means of a bayonet mechanism.

5. The assembly according to claim 1, wherein the body and the head are tight-fitted together.

6. The assembly according to claim 1, wherein the head is radially spaced away from the inner radial flange and from the radially outer flange.

7. The assembly according to claim 1, wherein the head is T-shaped and comprises an inner portion with a polygonal cross-section and an axisymmetric outer portion.

8. The assembly according to claim 1, wherein the head passes through the casing.

9. The assembly according to claim 1, wherein the abutment extends in the radial direction and a plurality of pins extend in an axial direction, each of the pins passing through the radially outer flange of the casing and through the inner radial flange of the distributor.

10. A method of servicing an assembly for a turbomachine, wherein the assembly comprises:

a turbine distributor comprising an annular platform, an inner radial flange extending radially inwardly from the platform, and one or more vanes extending radially outwardly from the platform;

a casing comprising a radially outer flange; and an abutment axially holding the radially outer flange in contact with the inner radial flange;

wherein the abutment is constituted by a head and a body, the body being removably connected to the head, said method comprising, in this order:

a step of removing the body of the abutment; and a step of removing the distributor, during which the head of the abutment remains engaged in the casing.

11. The method according to claim 10, additionally comprising a step of reassembling the distributor and then a step of fixing the body of the abutment to the head of the abutment.

* * * * *